United States Patent [19]

Lundgren

[11] 4,456,316

[45] Jun. 26, 1984

[54] DEVICE FOR STORAGE OF SHOES AND SIMILAR

[76] Inventor: Bengt Lundgren, Skarviksvägen 46, S-430 94 Bohus Björkö, Sweden

[21] Appl. No.: 304,893

[22] Filed: Sep. 23, 1981

[51] Int. Cl.[3] ..... A47B 77/06

[52] U.S. Cl. ..... 312/229

[58] Field of Search ..... 211/340, 35, 36, 37, 211/135; 312/373, 324, 333, 334, 229

[56] References Cited

U.S. PATENT DOCUMENTS

| | | | |
|---|---|---|---|
| 153,979 | 3/1904 | Hall | 312/229 X |
| 2,280,381 | 4/1942 | Davis | 211/35 |
| 2,635,027 | 4/1953 | Rasmussen | 312/229 |
| 3,468,426 | 9/1969 | Loewy | 211/35 |
| 3,587,864 | 6/1971 | Delisle | 211/37 |

FOREIGN PATENT DOCUMENTS

| | | | |
|---|---|---|---|
| 571857 | 3/1959 | Canada | 312/229 |

*Primary Examiner*—William E. Lyddane
*Assistant Examiner*—Joseph Falk

[57] ABSTRACT

The present invention relates to a device for storage of shoes and the like on a shelf. The shelf comprises a number of shelvings positioned on top of each other for the support of the shoes and a back part. The device comprises a rear edge portion of each shelving. The rear edge portions allow passage of removed particles from the shoes like sand, dirt melt water and the like. A chute is positioned between the back part and the rear edge portion and extends from the uppermost shelving and past the lowermost shelving. The chute allows the removed particles to fall downwards. A container is provided for collecting downfalling particles and is positioned below the chute.

1 Claim, 4 Drawing Figures

DEVICE FOR STORAGE OF SHOES AND SIMILAR

The present invention relates to a device for storage of shoes and the like on a shelf which comprises a number of shelving positioned on top of each other for the support of the shoes and a back part.

A draw-back in connection with storage of shoes and the like by means of shelves, which thus exhibit a number of shelvings situated one on top of the other, is that sand, dirt, melt water and the like will be collected on the shelvings, which must be cleaned relatively often. Prior known devices are, however, relatively complicated to clean. A type more easy to clean comprises a frame where the shelvings are substituted by grates so that sand, dirt and the like can fall down. These grates, however, have the draw-back that when arranging several grates on top of each other, sand, dirt, melt water and the like will fall down to the grate below and thereby soil the shoes placed on these grates.

The object of the present invention is to eliminate the above mentioned draw-backs in connection with the known solutions.

Said object is obtained by means of a device, in which said device comprises a rear edge portion of each shelving, said portions being arranged to allow passage of removed particles from the shoes like sand, dirt, melt water and the like, a chute positioned between said back part and said rear edge portion and extending from the uppermost shelving and past the lowermost shelving, said chute allowing said removed particles to fall downwards, and a container for collecting downfalling particles, said container being positioned below said chute.

Figure 1:
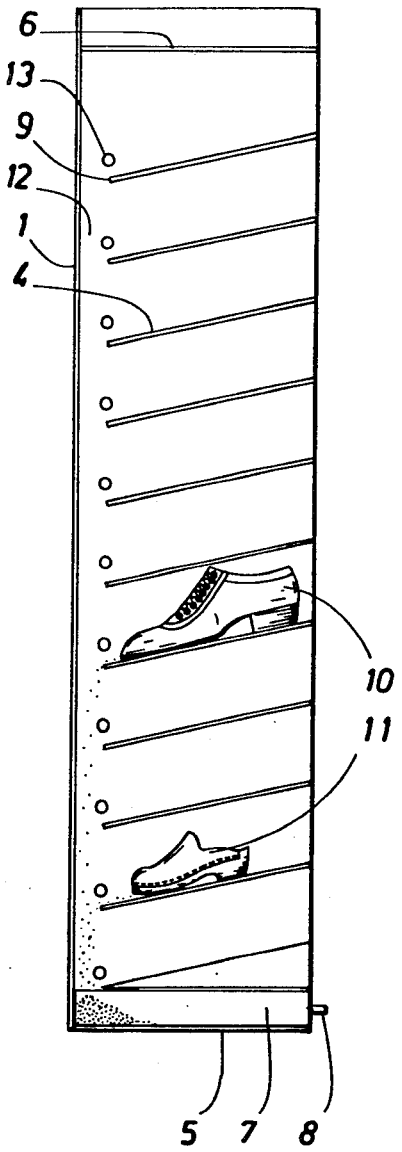
Figure 2:
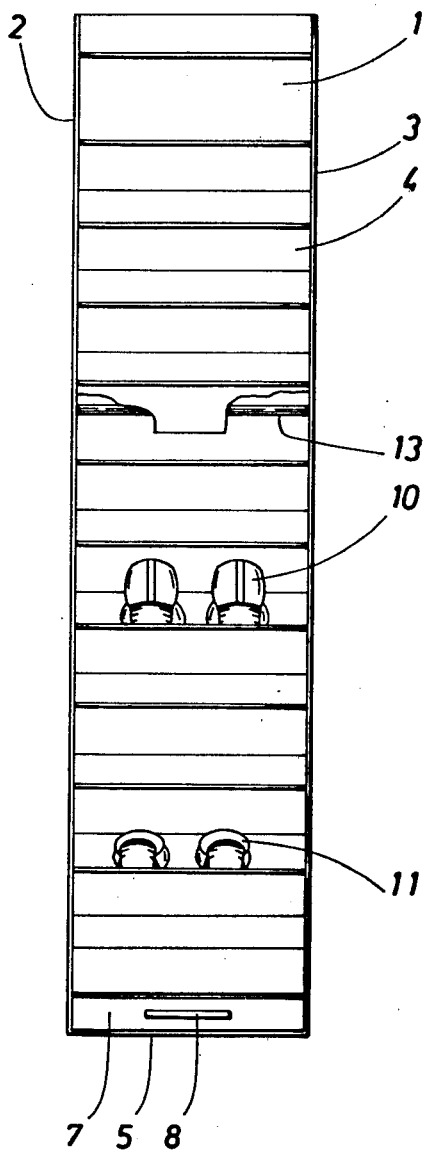
Figure 3:
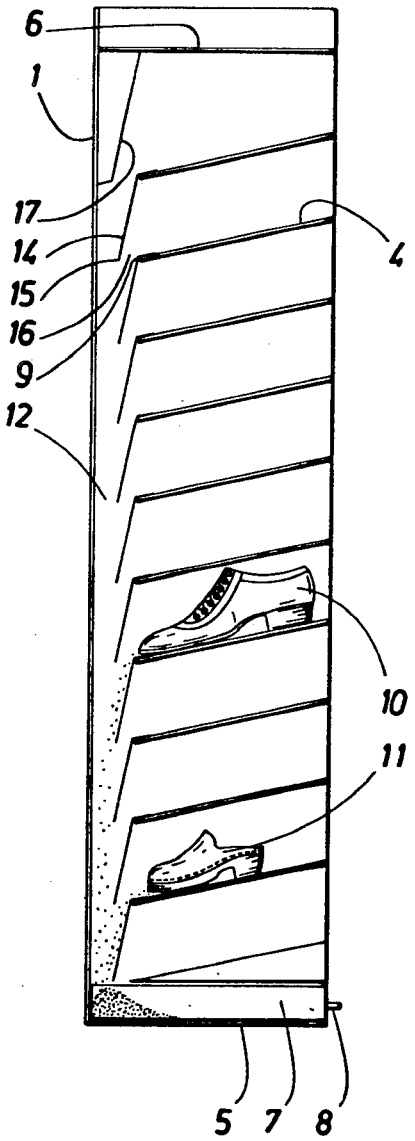
Figure 4:
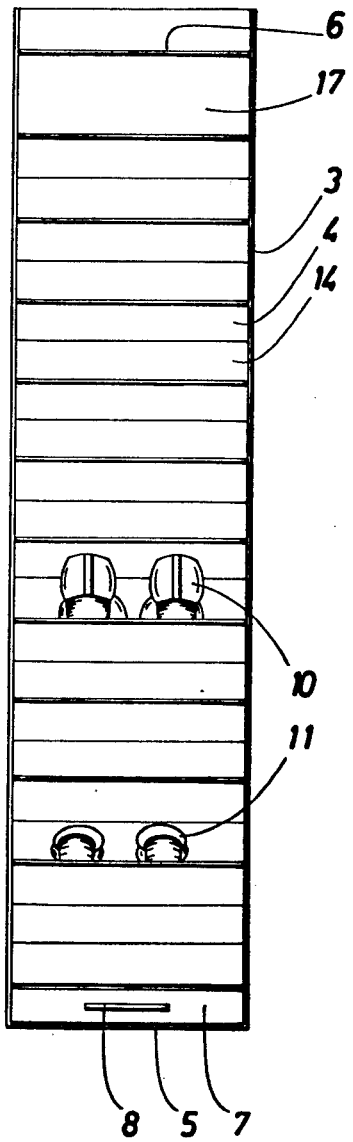

The invention will in the following be more closely described with some embodiments, reference being made to the accompanying drawings, in which FIG. 1 is a side view of a device according to the invention in a first embodiment, whereby its gable-end is removed for the sake of clearness, FIG. 2 is a partly broken view from the front of a device according to the present invention, FIG. 3 is a view corresponding to another embodiment of FIG. 1 of the device according to the invention, while FIG. 4 is a view from the front of the device according to FIG. 3.

As is evident from the first embodiment according to FIGS. 1 and 2 the device according to the invention for storage of shoes and the like comprises mainly a back piece 1 and two gable ends 2, 3 and a number of shelvings 4 extending between the gable ends. Furthermore, the device which in the following for the sake of simplicity is called the shoe shelf, has a bottom portion 5 with which the shoe shelf is resting against a support, for example a floor. In principle it is, however, conceivable that the shelf will be hung on a wall or the like. The shelvings 4 are lateral and intended to carry shoes and similar, from which sand, dirt, melt water from ice and snow and similarly not desired material can be removed. Above these lateral shelvings is in the embodiment shown another shelving 6, which does not need to be lateral and which is intended for things like gloves, mittens and the like. Below the lowermost of the shelvings 4 a container 7 is arranged in the form of an extractable drawer, which in the front has a handle 8, by means of which the drawer can be extracted from the shoe shelf. The drawer is open at the top and has four sides and a bottom. The container 7 is intended to collect material falling down, like sand, dirt, melt water and the like.

Each shelving 4 has a rear edge portion 9, which is intended to allow passage of removed material from the assembled shoes 10, 11. Along the back part 1 there extends between this and the rear edge portions 9 of the shelvings a chute 12. The chute extends from the uppermost lateral shelving 4 and down past the lowermost shelving and is connected to the upwardly open container. Furthermore, the mentioned chute 12 is in connection with the space between the shelvings in such a manner that removed material from the shoes 10, 11 can fall down from each shelving into the chute and down to the container 7. The shoe shelf further exhibits an especially arranged stop means 13 for each lateral shelving 4, which in the embodiment according to FIGS. 1 and 2 comprises a thread, pin or the like, which extends somewhat above and along the rear edge portion 9 of the shelvings 4. In the embodiment shown the stop means 13 extends between the two gable ends 2, 3 and is with its ends attached to these, as is evident from the broken portion in FIG. 2. The stop means 13 has as its function to prevent that the shoes 10, 11 are placed or gliding so that they protrude into the chute 12 and thereby will be soiled by material falling from above. At the same time the stop means 13 are made in such a way that they allow passage of removed material from each shelving 4 into the chute 12.

The embodiment according to FIGS. 3 and 4 of the shoe shelf differs from the first embodiment to that degree that each stop means consists of a plate element 14, which exhibits a lower edge portion 15, which together with the rear edge portion 9 of each lateral shelving forms an intermediate opening 16, through which the material removed from the shoes 10, 11 can pass into the chute 12. For all shelvings 4 with the exception of the top shelving, the plate element 14 consists of a sheet-shaped element, which is attached to the above positioned rear edge portion 9 of the shelving and hangs down from there. In the example shown the sheet-shaped element 14 is somewhat lateral and extends with its lowermost edge portion mainly in level with the below positioned back edge portion of the shelving 4 so that the opening 16 is directed downwards. By making the sheet-shaped element 14 completely closed, it will form a screen which efficiently prevents that the downfalling material will be brought counter-flow, i.e. through the opening 16 to the space between the shelvings in question. In conformity with the stop means shown in FIGS. 1 and 2 the sheet-shaped element 14 prevents that the shoes by mistake are placed or glide into the chute 12 and thereby be soiled. The stop means for the uppermost situated shelving is mainly of the same design but is instead fixed to the underside of the shelving 6 for gloves and the like. This stop means which is indicated 17 can for the sake of stability also be fixed to the back part 1 and with regard to cleaning it can be made as a closed box.

As to the principle of the invention the two embodiments function in the same manner. The material in the form of sand, dirt, melt water or the like removed at the positioning of the shoes 10, 11 on the shelving 4 in question, falls down and by the inclination of the shelving 4 is moved either by itself or at the later positioning of shoes or by a simple brushing in direction towards the rear edge portion 9 of the shelvings and passes via these past the stop means 13, 14 into the chute 12. Through the chute 12 the material from the shelving in question falls past the below situated shelvings at the side thereof straight down into the upwardly open container. With this arrangement of the shoes they are not exposed to the material falling down but are well protected as the shelvings 4 are completely closed. The collected material can afterwards simply be removed by the collecting container 7 being pulled out and its contents emptied in for example a garbage container. This emptying can, based on experience, take place in relatively long time intervals.

The shoe shelf can be manufactured in a material with a suitable rigidity, for example a wooden material like solid wood, chipboard or the like, or a plastic material and be manufactured with a robust surface coating easy to clean.

The invention is not limited to the above described and in the drawings shown embodiments, but can be varied within the scope of the following claims. The stop means can be designed in a number of different ways and comprise any element which prevents that the shoes are placed in the chute, but allows that removed particles are passing the back edge portion of the shelving into the chute 12. Furthermore, the container 7 can be designed in different ways and possibly as an extractable plate or in connection with a shoe shelf hanging on the wall as a plate which is pivotable downwards.

I claim:

1. Device for storage of shoes on a shelf, which comprises a plurality of shelvings positioned on top of each other for the support of the shoes and a back part positioned behind said shelvings, said shelvings being inclined so as to slope towards the back part, wherein said device comprises a front edge portion and a rear edge portion of each shelving, said portions being arranged to allow passage of removed particles from the shoes such as sand, dirt and the like, a chute positioned between said back part and said rear edge portions and extending from the uppermost shelving and past the lowermost shelving, said chute allowing said removed particles to fall downwards, a container for collecting downfalling particles said container being positioned below said chute, and each shelving being provided with a stop means which is arranged to prevent the shoes to be placed on the shelving in such a manner that they extend into said chute, said stop means comprising a plate element protruding from above and forming a protection shield covering the major part of the area between the rear edge portion of the respective shelf and the above adjacent shelving, said plate element of each shelving extending downwards from the above positioned shelving and being provided with a lower edge portion which is close to and which together with the positioned rear edge portion of the respective shelving delimits an opening through which the removed particles from the shoes and the like can pass into the chute, wherein the plate element extends inclined downwards towards said chute and the lower edge portion of the plate element is situated beside the rear edge portion of its respective shelving, mainly in level with the rear edge portion of its respective shelving, so that said opening from each shelving into the chute is directed downwards towards said container, and wherein substantially all the shelvings have their respective plate elements fixed to the rear edge portion of the shelving positioned thereabove, each of said shelvings and plate elements forming a continuous shielding unit, extending from the front edge portion of the shelving mainly to the level of the rear edge portion of the shelving positioned therebelow.

* * * * *